US007243642B2

(12) United States Patent
Nishikawa et al.

(10) Patent No.: US 7,243,642 B2
(45) Date of Patent: Jul. 17, 2007

(54) BREATHER DEVICE OF ENGINE

(75) Inventors: Hiroyasu Nishikawa, Osaka (JP); Satoshi Iwata, Osaka (JP); Yasuhiro Ozaki, Osaka (JP); Michio Sakata, Osaka (JP); Kaichi Takeuchi, Osaka (JP)

(73) Assignee: Yanmar Co., Ltd. (JP)

( * ) Notice: Subject to any disclaimer, the term of this patent is extended or adjusted under 35 U.S.C. 154(b) by 0 days.

(21) Appl. No.: 10/489,781

(22) PCT Filed: Jul. 15, 2002

(86) PCT No.: PCT/JP02/07185

§ 371 (c)(1),
(2), (4) Date: Mar. 17, 2004

(87) PCT Pub. No.: WO03/025354

PCT Pub. Date: Mar. 27, 2003

(65) Prior Publication Data

US 2004/0244785 A1 Dec. 9, 2004

(30) Foreign Application Priority Data

Sep. 18, 2001 (JP) ..... 2001-283704
Sep. 18, 2001 (JP) ..... 2001-283705
Sep. 18, 2001 (JP) ..... 2001-283706

(51) Int. Cl.
*F02F 7/00* (2006.01)

(52) U.S. Cl. ..... 123/572

(58) Field of Classification Search ..... 123/572–574, 123/41.86
See application file for complete search history.

(56) References Cited

U.S. PATENT DOCUMENTS 2,386,765 A * 10/1945 Adams et al. ..... 123/574
2,461,206 A * 2/1949 Fouse et al. ..... 123/574

(Continued)

FOREIGN PATENT DOCUMENTS

JP 57-63912 4/1982

(Continued)

*Primary Examiner*—Marguerite McMahon
(74) *Attorney, Agent, or Firm*—Sterne, Kessler, Goldstein & Fox P.L.L.C.

(57) ABSTRACT

A breather device comprises a breather chamber (22) provided in a valve arm chamber (2) arranged above a cylinder head of an engine. In the breather chamber, blow-by gas including oil mist is separated into oil component and gas component, and the oil mist is removed from the blow-by gas. The interior of the breather chamber is alternately divided into plural horizontally juxtaposed rooms (22*a*, 22*b*, 22*c*) by a partition (23) extended from a bottom surface of the breather chamber and a partition (2*a*) extended from a ceiling surface of the breather chamber. Plural oil trap members (10) for trapping oil mist in the blow-by gas are arranged in the breather chamber. Especially, the oil trap member arranged at a blow-by gas inlet of the breather chamber is held by a holder (11) made separately from members (2, 7) forming the valve arm chamber (5).

12 Claims, 14 Drawing Sheets

U.S. PATENT DOCUMENTS 3,209,738 A * 10/1965 Powers ..... 123/574
3,754,538 A * 8/1973 Ephraim et al. ..... 123/41.86
4,459,966 A * 7/1984 Sakano et al. ..... 123/573
4,501,234 A * 2/1985 Toki et al. ..... 123/41.86
4,602,607 A * 7/1986 Balsley ..... 123/574
4,667,647 A * 5/1987 Ohtaka et al. ..... 123/573
4,881,510 A * 11/1989 Etoh et al. ..... 123/572
4,958,613 A * 9/1990 Hiraoka et al. ..... 123/572
6,412,478 B1 * 7/2002 Ruehlow et al. ..... 123/572
6,725,849 B2 * 4/2004 Stegmaier et al. ..... 123/572
6,802,303 B2 * 10/2004 Hakansson ..... 123/574

FOREIGN PATENT DOCUMENTS

| | | |
|---|---|---|
| JP | 59-127807 | 8/1984 |
| JP | 62-71322 | 5/1987 |
| JP | 1-113117 | 7/1989 |
| JP | 6-60714 | 8/1994 |
| JP | 11-200832 | 7/1999 |
| JP | 2000-274226 | 10/2000 |

* cited by examiner

PRIOR ART

BREATHER DEVICE OF ENGINE

BACKGROUND OF THE INVENTION

1. Field of the Invention

The present invention relates to a structure of a breather device for an engine, made in a valve arm chamber that covers an upper side of a cylinder head.

2. Background Art

Conventionally, an engine has a breather chamber in a valve arm casing that covers an upper side of a cylinder head of an engine is formed a breather chamber, in which blow-by gas including oil mist is separated into oil component and gas component.

This breather chamber is made as a space surrounded by side walls of the valve arm casing, ribs jutting from inside surfaces of the valve arm casing, and a base plate installed at regular intervals from the inside surfaces of the valve arm casing. A filter gauze arranged in the breather chamber traps oil mist (oil component) in blow-by gas, and removes it from the gas.

However, the conventional breather device merely comprising the filter gauze at an inlet portion of the breather chamber has insufficient ability for removing oil component. Moreover, if a structure of recirculating the blow-by gas having passed the breather chamber into intake gas is applied, the intake gas is mixed with oil, thereby increasing emission in exhaust gas far from decreasing it.

A pressure-regulating valve is arranged at an outlet portion of the breather chamber for blow-by gas so as to regulate pressure in the breather chamber. As shown in FIG. 14, for instance, a conventional pressure-regulating valve 40 comprises a diaphragm 41, a spring 42, and a center plate 43, so that the spring 42 energizes the diaphragm 41 downward, with the center plate 43 put between the spring 42 and the diaphragm 41. The diaphragm 41 cuts off communication between a gas passage 44 to the intake side and a breather chamber 45. When the pressure in the breather chamber 45 arises above a predetermined pressure, the diaphragm 41 is pressed and moved upward, so that the pressure-regulating valve 40 opens to bring the breather chamber 45 into communication with the gas passage 44.

This conventional pressure-regulating valve requires such many parts of the spring 42 and the center plate 43, thereby being expensive and complicated.

A conventional breather chamber is connected to an intake manifold through a breather pipe for recirculating blow-by gas through the breather chamber into intake gas. However, if the negative pressure in intake side is propagated into the valve arm chamber at a breath, blow-by gas is let into the intake manifold rapidly, so that much oil component moves to the intake side at a breath, therefore engine performance falls down.

SUMMARY OF THE INVENTION

An object of the present invention is to provide a breather chamber formed in a valve arm chamber of an engine, enhancing the effect of removing oil mist from blow-by gas.

To attain the object, according to the present invention, plural rooms are formed in the breather chamber so as to ensure a long passage of blow-by gas in the breather chamber, thereby enhancing the effect of removing oil mist, and lowering the increase of emission in exhaust gas caused by recirculating the blow-by gas into intake gas.

According to the present invention, plural oil trap members for trapping oil mist in the blow-by gas are arranged in the breather chamber so as to remove oil mist from the blow-by gas by steps, thereby enhancing the effect of removing oil mist.

According to the present invention, a holder for holding the oil trap member which traps oil mist in the blow-by gas is arranged in the breather chamber, wherein the holder is separated from a member forming the valve arm chamber, thereby facilitating exchange of the oil trap member and maintenance of the valve arm chamber.

According to the present invention, partitions alternately extended from bottom and ceiling surfaces of the breather chamber divide the interior of the breather chamber into horizontally juxtaposed plural rooms. In this way, the plural rooms can be simply formed so as to ensure the sufficiently long passage of blow-by gas without changing the height of the engine.

According to the present invention, an oil trap member for trapping oil mist in the blow-by gas is arranged at a blow-by gas inlet of the breather chamber, and a discharge vent is formed near the oil trap member so as to naturally discharge oil collected on the bottom in the breather chamber. Blow-by gas is let into the breather chamber through this oil trap member so as to surely remove oil mist, thereby lowering the consumption of oil.

According to the present invention, the blow-by gas inlet is formed in the holder, and a guide portion extended outward from the breather chamber is provided to the inlet so as to get the oil mist adhering thereto before the blow-by gas is let into the breather chamber, thereby removing the oil mist.

According to the present invention, a pressure-regulating valve for regulating pressure is arranged in the room nearest an outlet of the breather chamber among the plural rooms formed in the breather chamber. Accordingly, while the sufficiently long passage of the blow-by gas is ensured in the breather chamber and the enhanced effect of removing oil mist is ensured, the pressure in the valve arm chamber is keep constant, thereby preventing an oil seal from deflecting and deteriorating.

A second object of the present invention is to provide a pressure-regulating valve for regulating pressure in the breather chamber which is arranged at a blow-by gas outlet portion of the breather chamber, wherein the pressure-regulating valve is simple and economic with reduction of required parts.

To attain the object, according to the present invention, a pressure-regulating valve is opened and closed by sliding movement of a ball-like member, wherein the ball-like member slides basing on the blow-by gas pressure in the breather chamber. In comparison with a conventional pressure-regulating valve having a diaphragm energized by a spring, the present valve assembly can be inexpensive and simple because it doest not require members such as a spring and a center frame used by the conventional pressure-regulating valve.

Alternatively, a pressure-regulating valve may comprise a diaphragm arranged above an outlet of the breather chamber, and a weight member downwardly energizing a valve surface of the diaphragm, wherein the outlet of the breather chamber essentially closed by the valve surface of the diaphragm is opened against the energizing force of the weight member by increasing the blow-by gas pressure in the breather chamber. In comparison with a conventional pressure-regulating valve having a diaphragm energized by a spring, the present valve assembly can be inexpensive and simple because it doest not require members such as a spring and a center frame used by the conventional pressure-regulating valve.

Alternatively, the pressure-regulating valve may comprise a diaphragm arranged above an outlet of the breather chamber, wherein the surface of the valve of the diaphragm is energized downward by its own elasticity, and the outlet of the breather chamber essentially closed by the valve surface of the diaphragm is opened against the elastic force of the diaphragm by increasing the blow-by gas pressure in the breather chamber. In comparison with a conventional pressure-regulating valve having a diaphragm energized by a spring, the present valve assembly can be inexpensive and simple because it doest not require members such as a spring and a center frame used by the conventional pressure-regulating valve. Furthermore, the diaphragm having the center frame is not subjected to pressure caused by the center frame, thereby being improved in durability.

A third object of the present invention is to provide an arrangement of recirculating blow-by gas through a breather chamber into intake gas, wherein oil component moved to intake side causing declination of engine performance is reduced.

To attain the object, according to the present invention, an orifice is formed at a blow-by gas inlet of an intake manifold for introducing blow-by gas passing through the breather chamber so that pressure in the valve arm chamber including the breather chamber is stabilized without microseisms, thereby keeping a seal member from deteriorating. The orifice prevents rapid entrance of blow-by gas into the intake manifold so as to reduce oil component moved to the intake side.

If a pressure-regulating valve for regulating pressure in the breather chamber is additionally arranged at the blow-by gas outlet of the breather chamber, the pressure in the valve arm chamber is kept constant, thereby enhancing the effect of preventing an oil seal from deflecting and deteriorating, and the effect of reducing oil component moved to the intake side with prevention of rapid entrance of blow-by gas into the intake manifold.

Alternatively, according to the present invention, a device for preventing oil hummer is interposed between the breather chamber and the intake manifold so as to prevent sudden entrance of much oil into the intake side, thereby keeping engine performance from falling.

The device for preventing oil hummer may be combined with the orifice at the blow-by gas inlet portion of the intake manifold, or with the pressure-regulating valve at the blow-by gas outlet of the breather chamber, or with both of them, so as to ensure synergy of the above-mentioned effects.

These, further and other objects, features, and advantages of the present invention will appear more fully from the following description with reference to attached drawings.

DETAILED DESCRIPTION OF THE INVENTION

Figure 1:
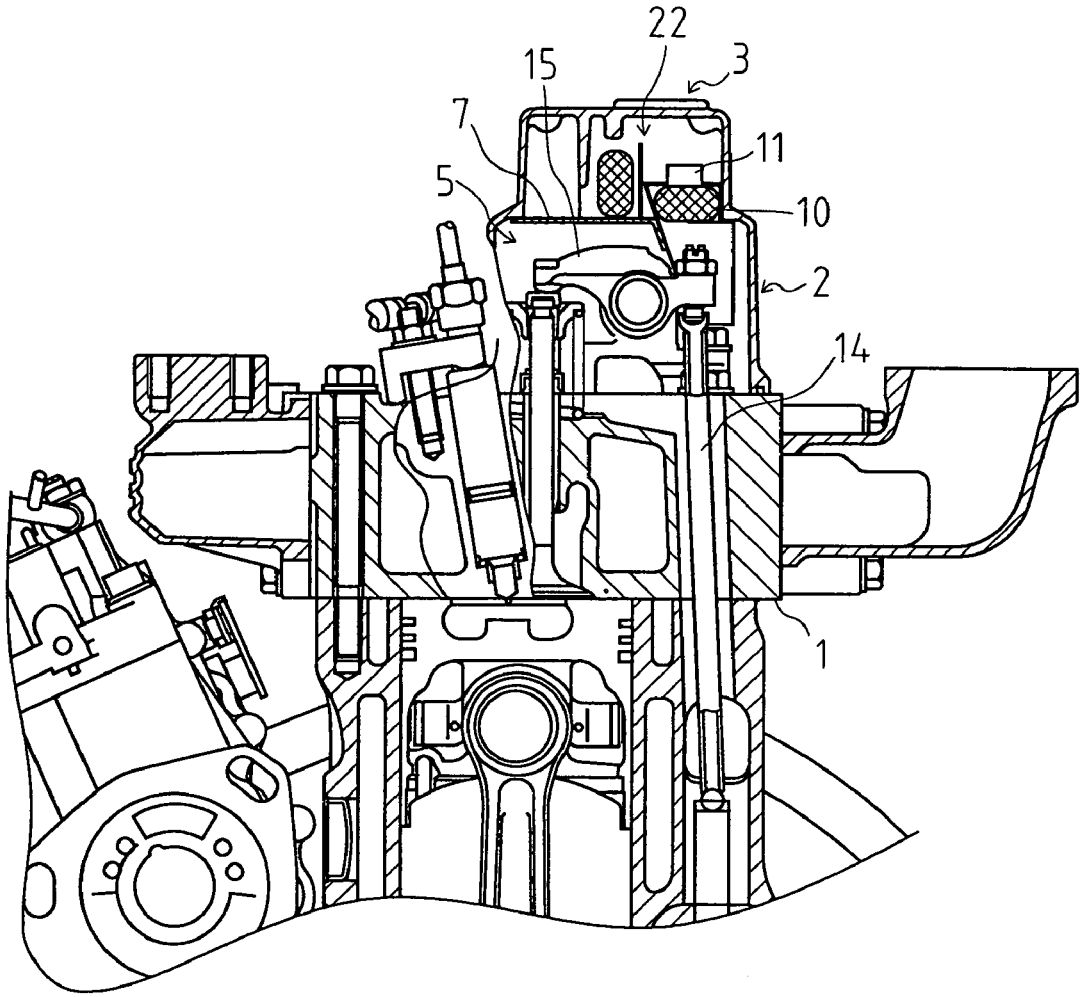
FIG. 1 is a sectional front view of a valve arm chamber comprising a breather device according to the present invention.
Figure 2:
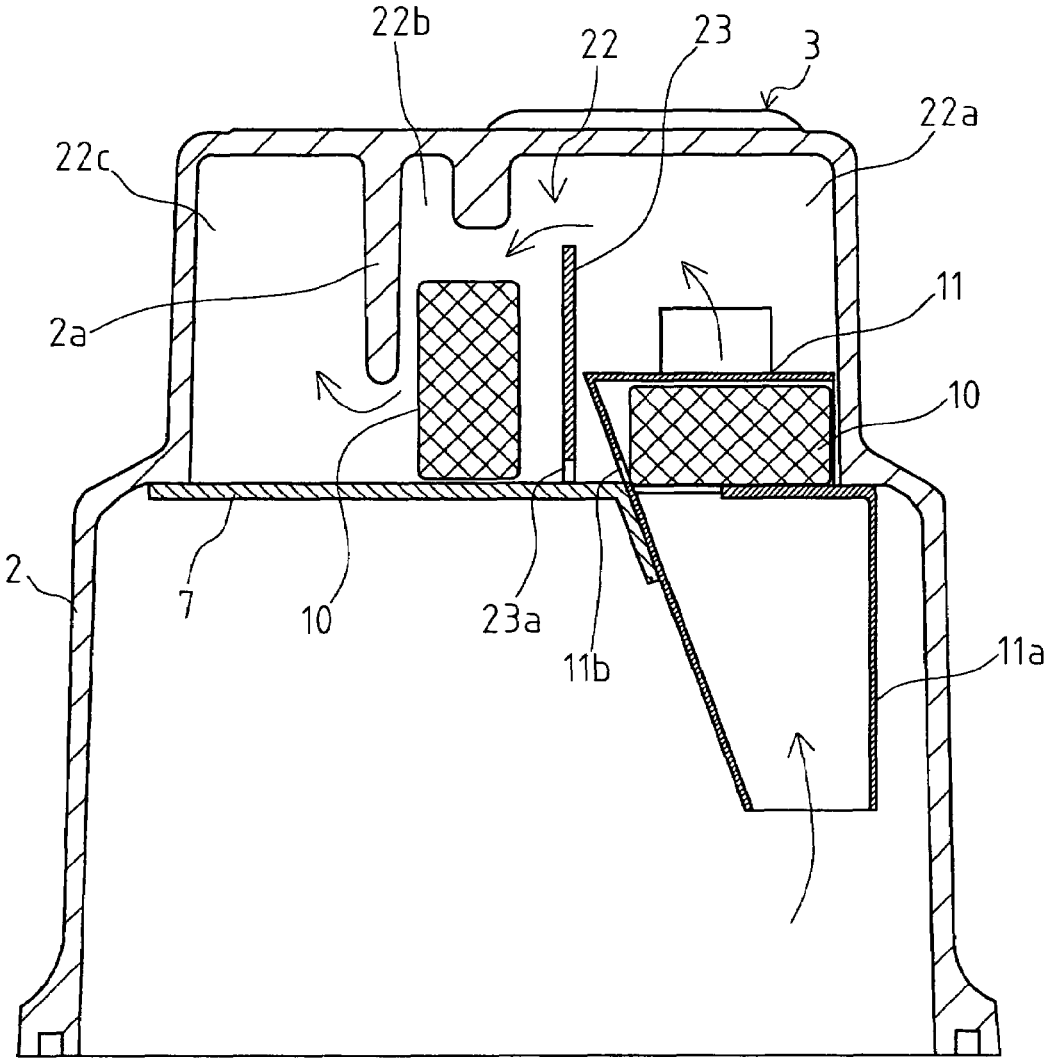
FIG. 2 is an expanded sectional front view of a breather chamber.
Figure 3:
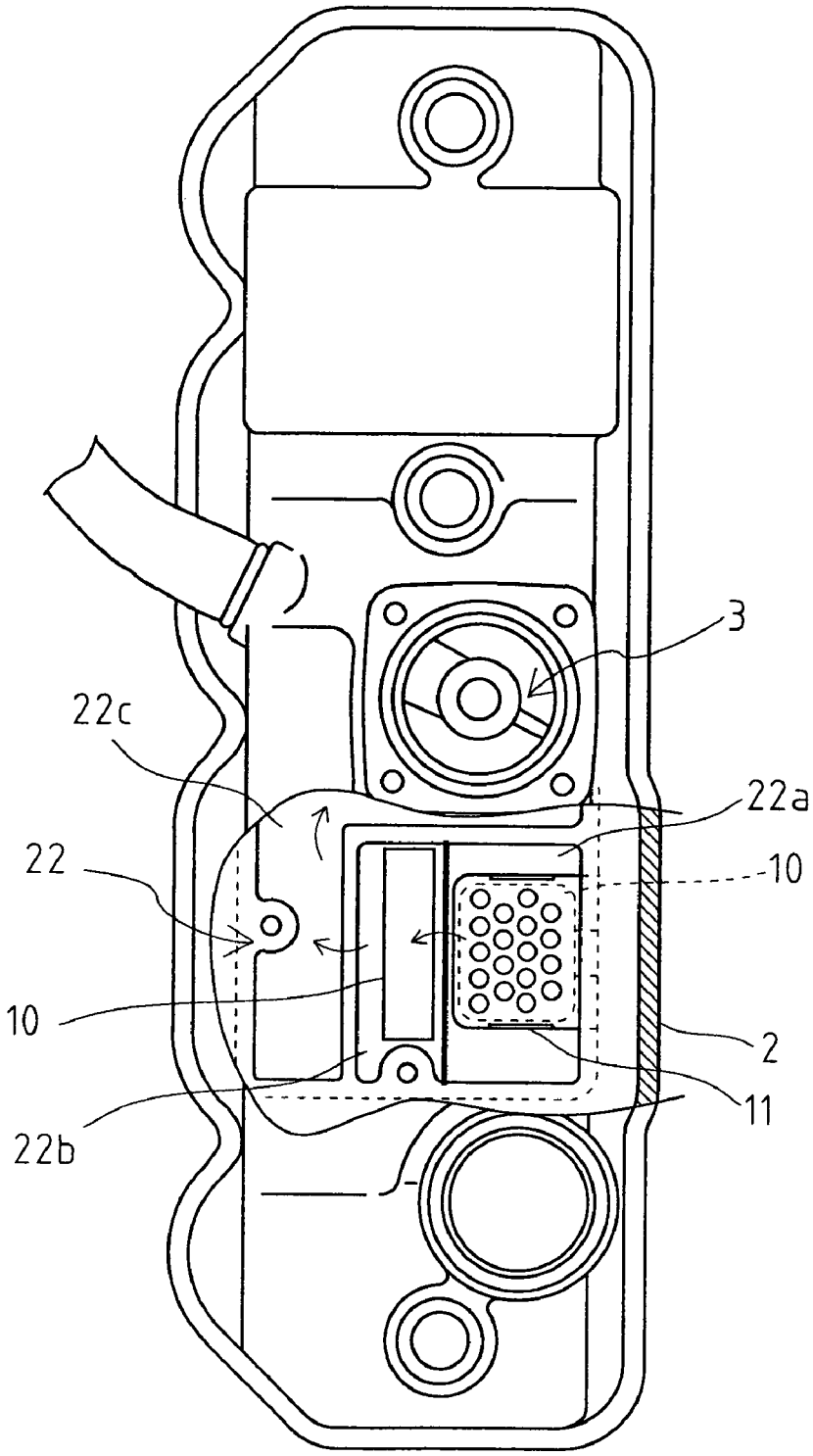
FIG. 3 is a plan view partly in section of the breather chamber.

As shown in FIG. 1 to FIG. 3, a valve arm casing 2 is arranged above a cylinder head 1 of an engine so as to constitute a valve arm chamber 5 in which an upper part of an inlet valve, an upper part of an exhaust valve, an upper part of a push rod 14, a valve arm 15, a fuel injection valve, and the like are installed.

A pressure control chamber 3 is attached to the top surface of the valve arm casing 2, and a breather chamber 22 is formed at the lower part of the pressure control chamber 3. The breather chamber 22 is surrounded by inner surfaces of the valve arm casing 2 and a shielding board 7 arranged in the valve arm casing 2.

The breather chamber 22 is provided therein with a partition 23 extended from the bottom surface thereof and a partition 2*a* extended from the ceiling surface thereof, which are alternately arranged to divide the inner space of the breather chamber 22 into horizontally juxtaposed rooms, i.e., a first room 22*a*, a second room 22*b* and a third room 23*c*.

A holder 11 is arranged in a lower part of the first room 22*a* of the breather chamber 22 so as to hold an oil trap 10 for trapping oil mist in the blow-by gas, and a blow-by gas inlet is formed in the holder 11. The holder 11 has a guide portion 11*a* extended outward (downward in FIG. 2) from the breather chamber 22 so that oil mist in the blow-by gas may adhere to the guide portion 11*a* before the blow-by gas is let into the breather chamber 22, thereby removing the oil mist.

Figure 4:
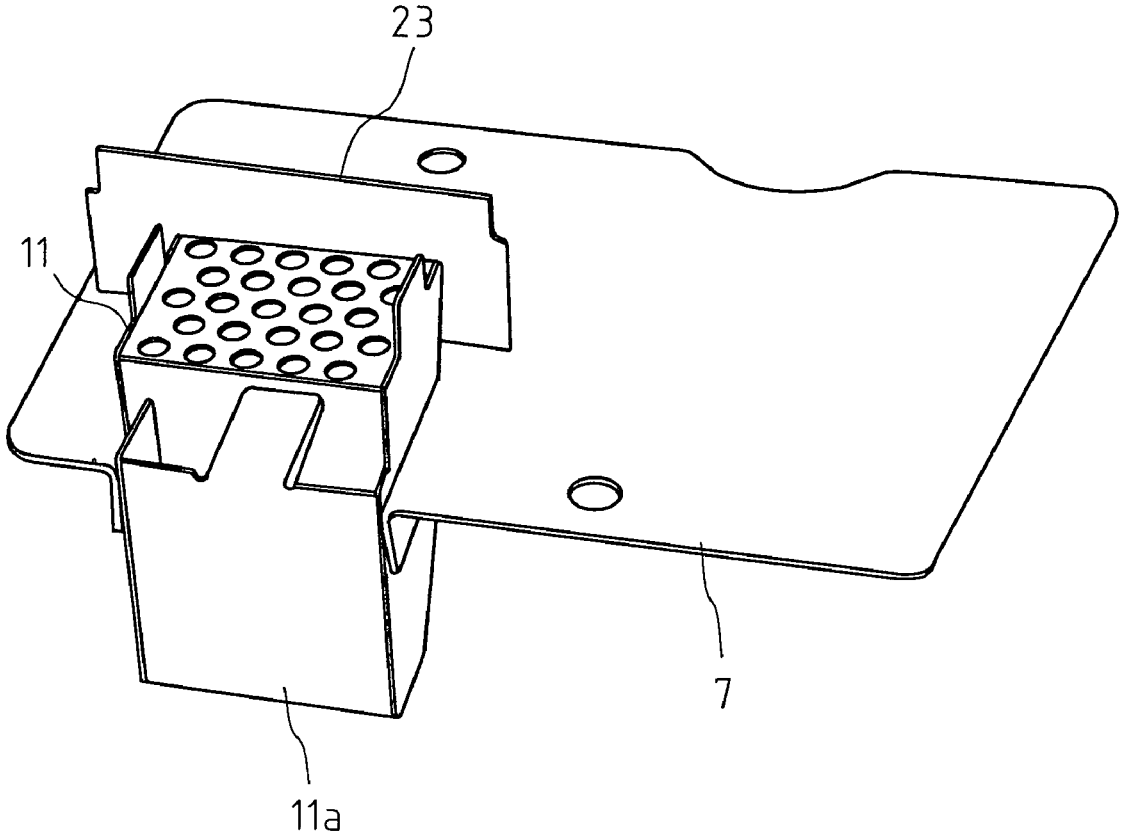
FIG. 4 is a perspective view of a holder for holding an oil trap member.

The oil trap 10 is a netlike member made of steel wool or the like. The oil trap 10 is held in the space surrounded by the holder 11 and sidewalls of the valve arm casing 2. As shown in FIG. 4, the holder 11 is formed separately from the valve arm chamber 5, thereby facilitating exchange of the oil trap 10 and maintenance of the valve arm chamber 5.

Another oil trap 10 is also arranged in the second room 22*b* of the breather chamber 22. A blow-by gas outlet formed in the third room 22*c* is connected to the pressure control chamber 3. The number of rooms formed in the breather chamber 22 and the number of oil traps arranged in the breather chamber 22 are not limited.

Due to the above structure, in the valve arm casing 2, the blow-by gas enters the inlet of the breather chamber 22 along the guide portion 11*a* of the holder 11, passes the oil trap 10 held by the holder 11, and enters the first room 22*a* of the breather chamber 22. The blow-by gas let into the breather chamber 22 passes through the first room 22*a*, the second room 22*b*, and the third room 22*c* in turn, and it is guided from the outlet of the third room 22*c* to the intake side of the engine through the pressure control chamber 3. While the blow-by gas passes the oil trap 10, the oil trap 10 traps oil mist so as to clear the blow-by gas of oil component. Also, the oil trap 10 arranged in the second room 22*b*, while the blow-by gas passing therethrough, traps oil mist so as to clear the blow-by gas of oil component.

Additionally, while the blow-by gas passes through the first room 22*a*, the second room 22*b*, and the third room 22*c*, oil mist in the blow-by gas adheres to wall surfaces of the breather chamber 22, thereby being removed from the blow-by gas.

As the above, the oil traps 10 remove oil mist from the blow-by gas by steps. The plural partitions can easily form the horizontally juxtaposed plural rooms in the breather chamber 22 so that such a significantly long passage of blow-by gas as to enhance the effect of removing oil mist can be ensured in the breather chamber 22 without changing the height of the engine. Therefore, emission in exhaust gas and consumption of oil, which tend to be increased by recirculating blow-by gas into intake gas, are restricted.

To discharge oil collected on the bottom of the breather chamber 22, a discharge vent 11*b* is formed in a lower portion of the holder 11 near the oil trap 10 arranged over the blow-by gas inlet of the breather chamber 22, and a discharge vent 23*a* is formed in a lower portion of the partition extended from the bottom face side, i.e., the partition 23 arranged between the first room 22*a* and the second room 22*b* in this embodiment. Accordingly, while blow-by gas passes the oil traps 10 in the breather chamber 22, oil stuck on the wall surfaces of the breather chamber 22 rolls down to the bottom surface, and then oil is naturally discharged through the discharge vents 23*a* and 11*b*, whereby oil mist can be surely removed.

Furthermore, the oil trap 10 held above the discharge vent 11*b* formed in the holder 11 is surely prevented from being immersed in the oil discharged from the breather chamber 22 through the discharge vent 11*b*, whereby the capacity of filtering blow-by gas by the oil trap 10 can be preserved.

Figure 5:
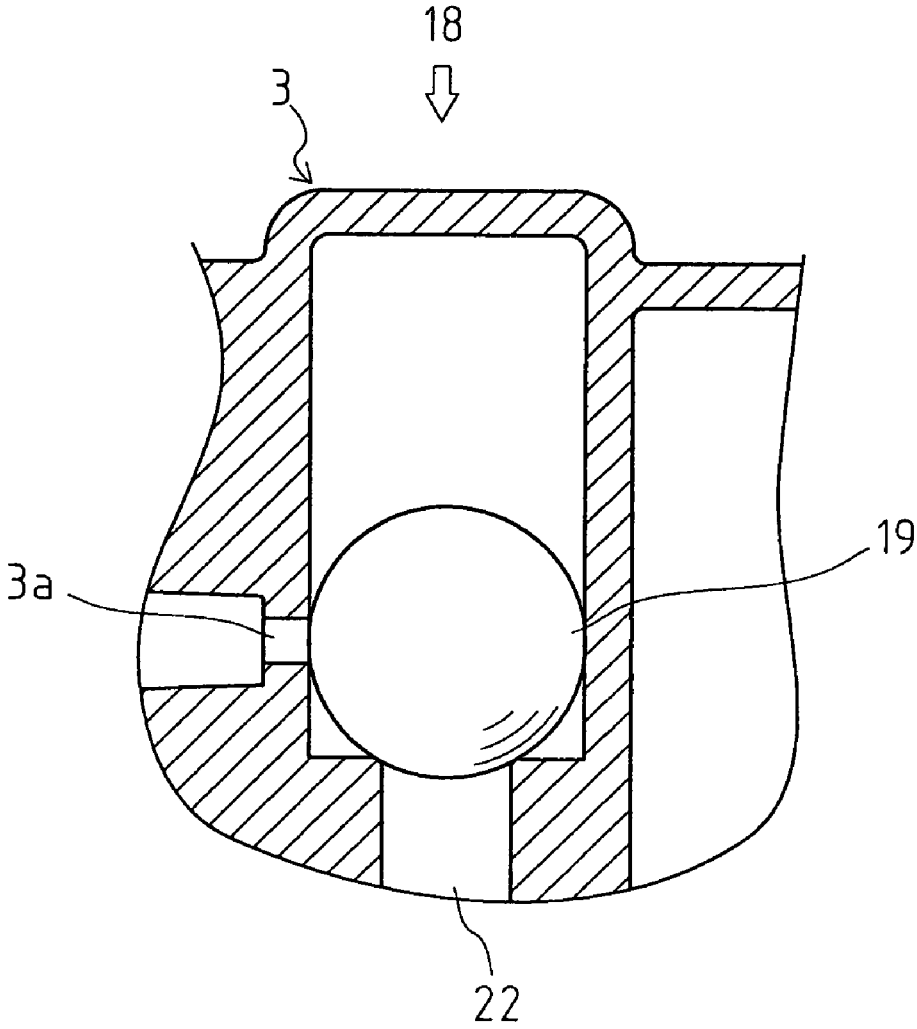
FIG. 5 is an expanded sectional view of a pressure control chamber.

As shown in FIGS. 3 and 5, the breather chamber 22 is provided with the blow-by gas outlet at the third room 22*c* in connection with the pressure control chamber 3. A gas passage 3*a* connected to the breather chamber 22 is formed from the pressure control chamber 3, and a pressure-regulating valve 18 for regulating pressure in the breather chamber 22 is interposed between the gas passage 3*a* and the breather chamber 22.

The pressure-regulating valve 18 is opened and closed according to sliding movement of a ball-like member 19, so that the blow-by gas pressure is regulated depending on the weight of the ball-like member 19. In other words, the pressure-regulating valve 18 essentially separates the breather chamber 22 and the gas passage 3*a* from each other. When the blow-by gas pressure in the breather chamber 22 rises above a predetermined pressure, the ball-like member 19 slides upward against its gravity and opens the outlet of the breather chamber 22 having been closed by the ball-like member 19, thereby bringing the breather chamber 22 into communication with the gas passage 3*a*, so that the blow-by gas from which oil component is removed passes through the gas passage 3*a*.

Due to this construction, the pressure in the valve arm chamber 5 is kept constant, thereby preventing an oil seal from deflecting and deteriorating. Compared with a conventional pressure-regulating valve having a diaphragm energized by a spring, the present valve which does not require a spring and a center plate is inexpensive and simple.

Figure 6:
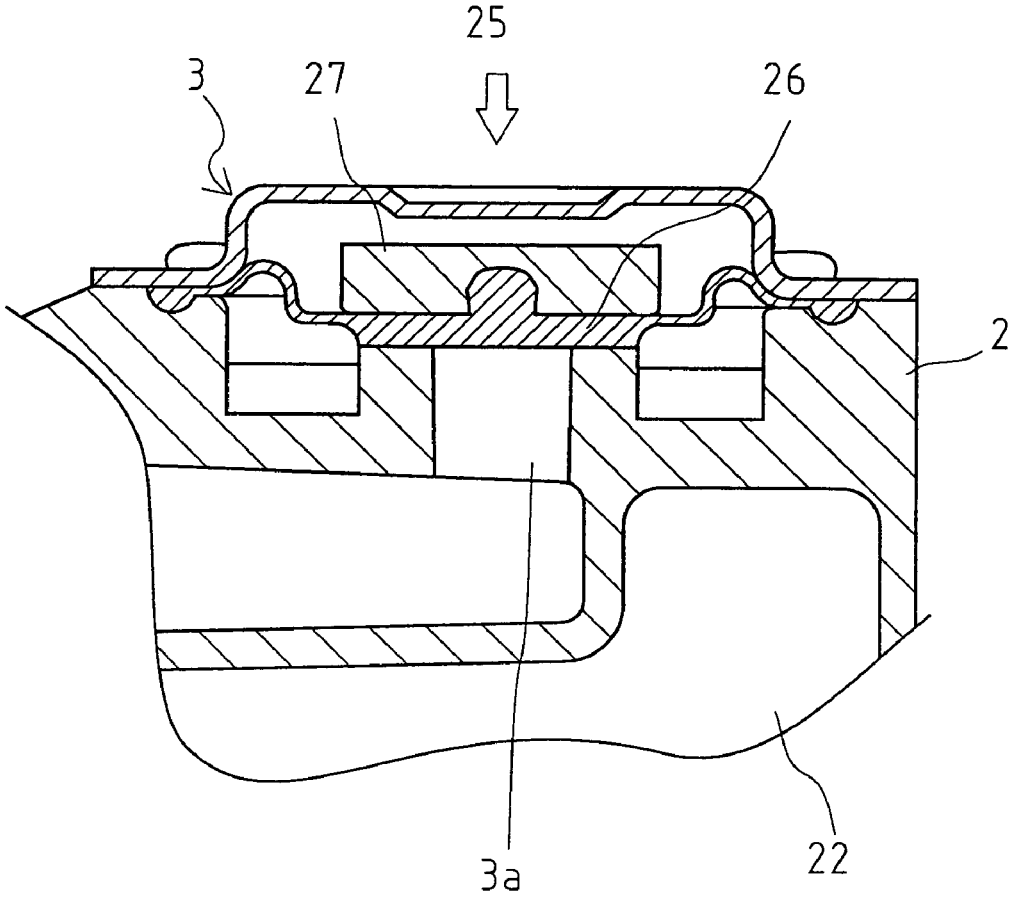
FIG. 6 is an expanded sectional view of a pressure control chamber according to a second embodiment.

Next, description will be given of a pressure-regulating valve of a second embodiment in accordance with FIG. 6.

A pressure-regulating valve 25 comprises a diaphragm 26 arranged above the outlet of the breather chamber 22, and a weight member 27 put on the diaphragm 26. The weight member 27 energizes a valve surface of the diaphragm 26 downward. When the blow-by gas pressure in the breather chamber 22 rises above a predetermined pressure, the diaphragm 26 is pushed up and moves upward against the energizing force of the weight member 27, whereby the outlet of the breather chamber 22 having been closed by the valve surface of the diaphragm 26 is opened, and the breather chamber 22 comes to communicate with the gas passage 3*a*.

Compared with a conventional pressure-regulating valve having a diaphragm energized by a spring, the valve of this embodiment does not have a spring and a center plate, thereby being inexpensive and simple.

Alternatively, a pressure-regulating valve may be made as follows.

Figure 7:
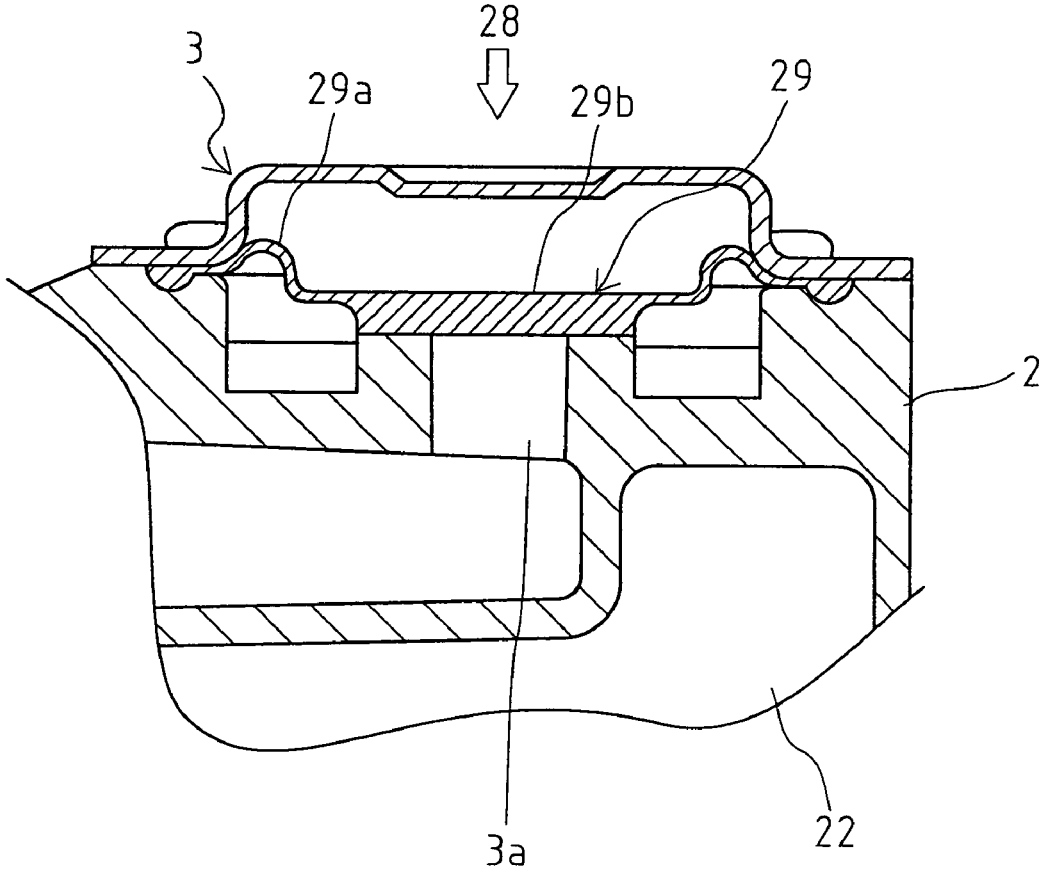
FIG. 7 is an expanded sectional view of a pressure control chamber according to a third embodiment.

As shown in FIG. 7, a pressure-regulating valve 28 comprises an elastic member serving as a diaphragm 29 arranged above the outlet of the breather chamber 22, wherein a valve surface of the diaphragm 29 is energized downward by its own elasticity.

Concretely, the diaphragm 29 assembled in the pressure-regulating valve 28 has the valve surface 29*b* for opening and closing the gas passage 3*a*, wherein the valve surface 29*b* is energized downward by an elastic edge 29*b* formed along its periphery.

By the blow-by gas pressure in the breather chamber 22 increased above a predetermined pressure, the outlet of the breather chamber 22 having been closed by the valve surface 29*b* of the diaphragm 29 is opened against the elastic force of the elastic edge 29*a*, so that the breather chamber 22 comes to communicate with the gas passage 3*a*.

Compared with a conventional pressure-regulating valve having a diaphragm energized by a spring, the present valve has neither a spring nor a center plate, thereby being inexpensive and facilitating for easy assembly. The diaphragm is improved in durability because it has no center plate pressed thereon.

In any of the aforementioned ways, the blow-by gas, from which oil component is removed in the breather chamber, opens the pressure-regulating valve, and passes through the gas passage 3*a*, and then goes into an intake manifold 16.

Figure 8:
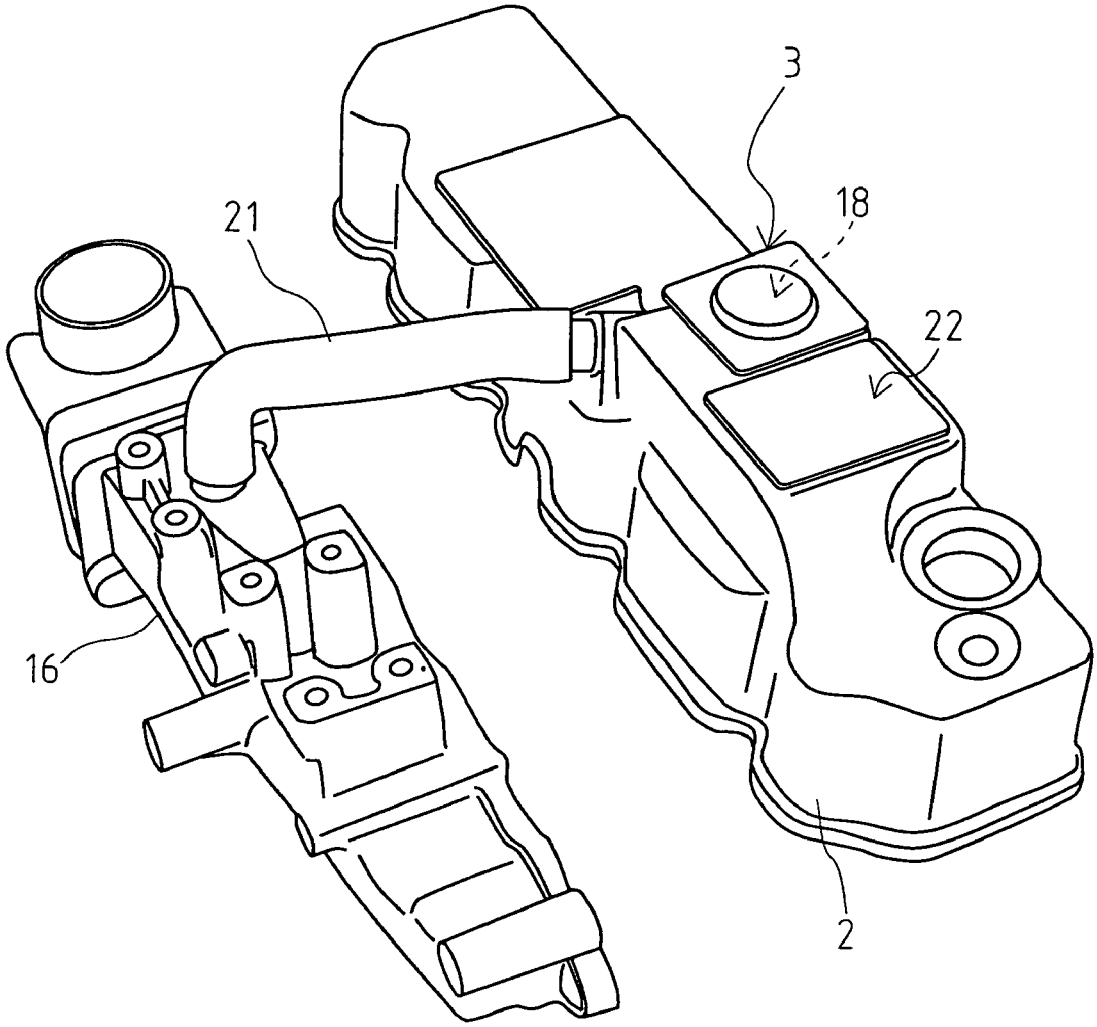
FIG. 8 is a perspective view of an intake manifold.
Figure 9:
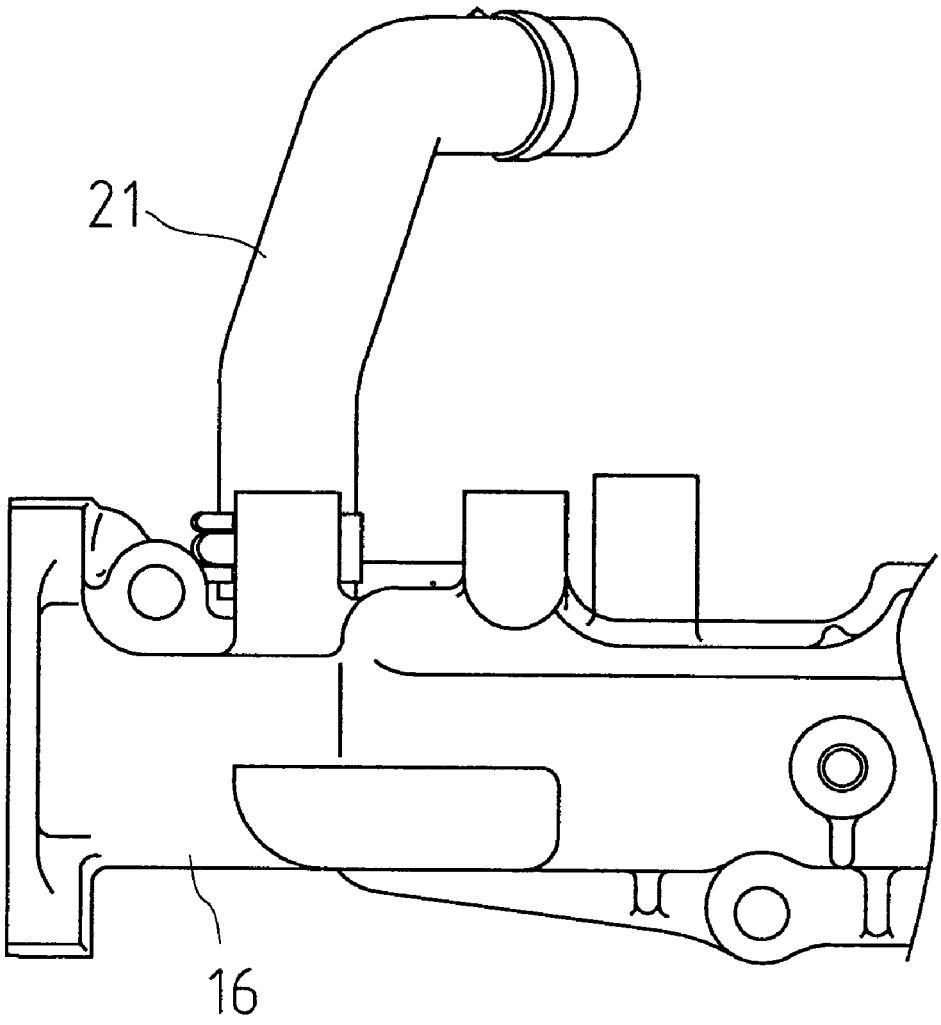
FIG. 9 is a side view of the intake manifold.
Figure 10:
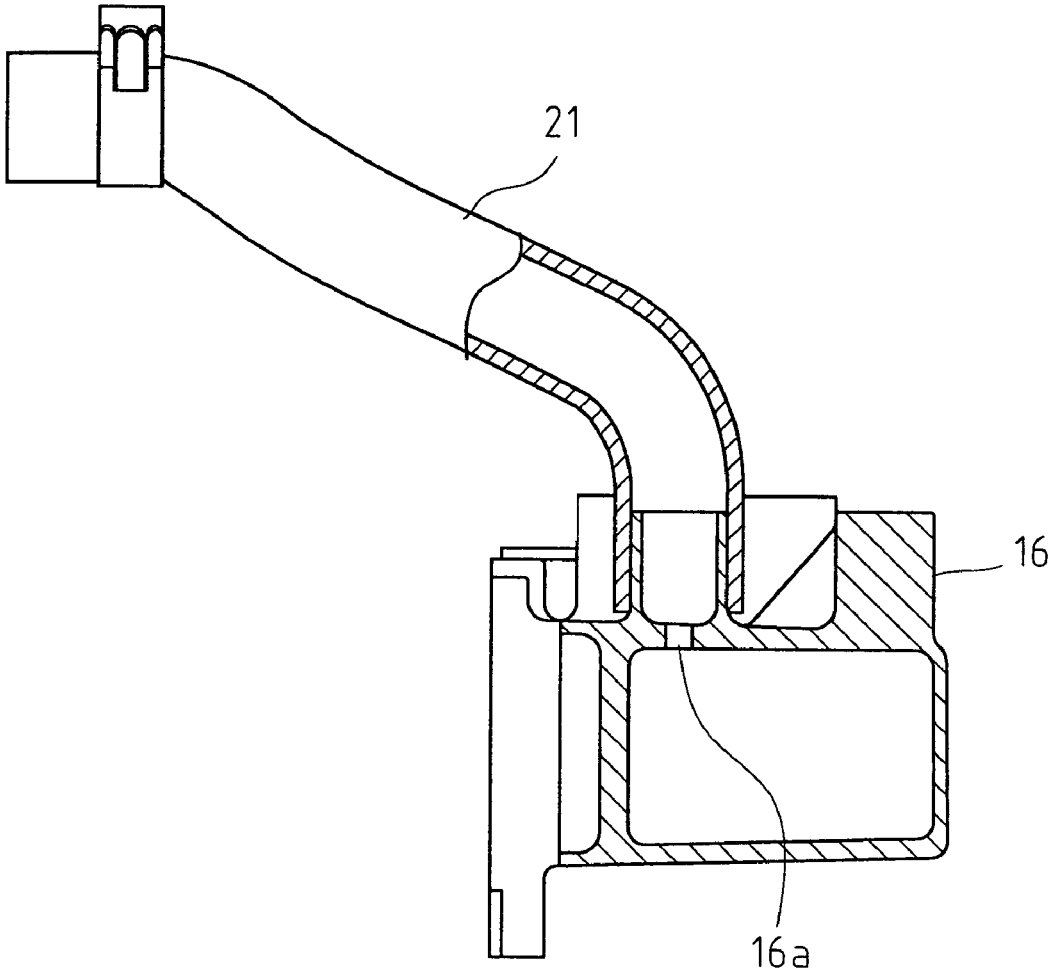
FIG. 10 is a sectional view of the intake manifold.

As shown in FIG. 8 to FIG. 10, a breather pipe 21 connects the breather chamber 22 to the intake manifold 16, and an orifice 16 is formed at a blow-by gas inlet of the intake manifold 16. The orifice 16*a* prevents the pressure in the valve arm chamber 5 including the breather chamber 22 from microseisms and stabilizes it, thereby keeping a seal member from deteriorating. The orifice 16*a* also prevents blow-by gas from being rapidly let into the intake manifold 16, thereby reducing oil component moved to the intake side.

Figure 11:
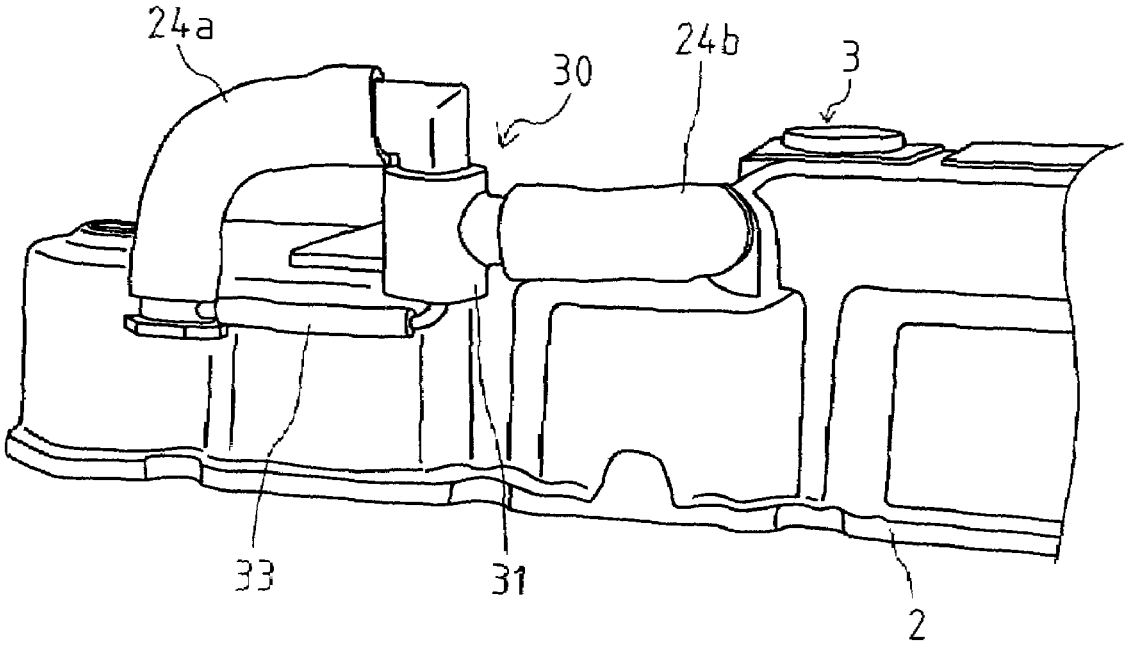
FIG. 11 is a perspective view showing a state that an oil hummer inhibiter is interposed at an intermediate portion of a breather pipe.
Figure 12:
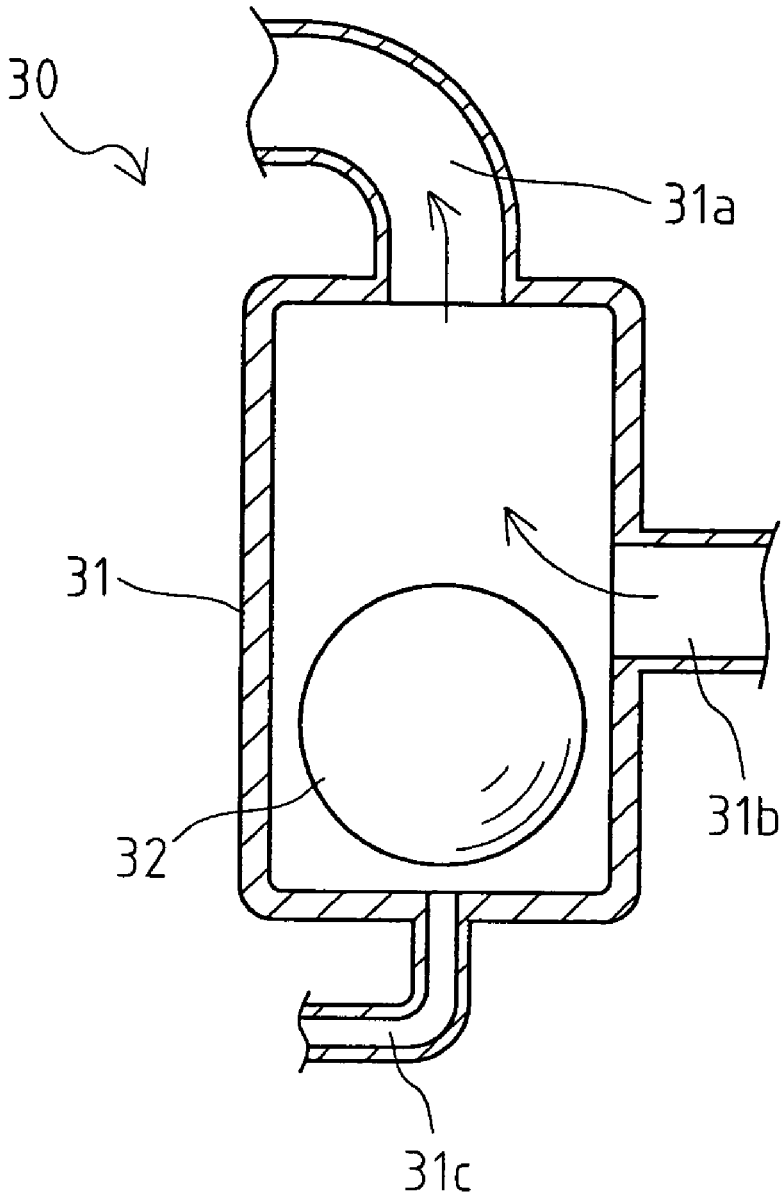
FIG. 12 is a perspective view of the oil hummer inhibiter in ordinary time.
Figure 13:
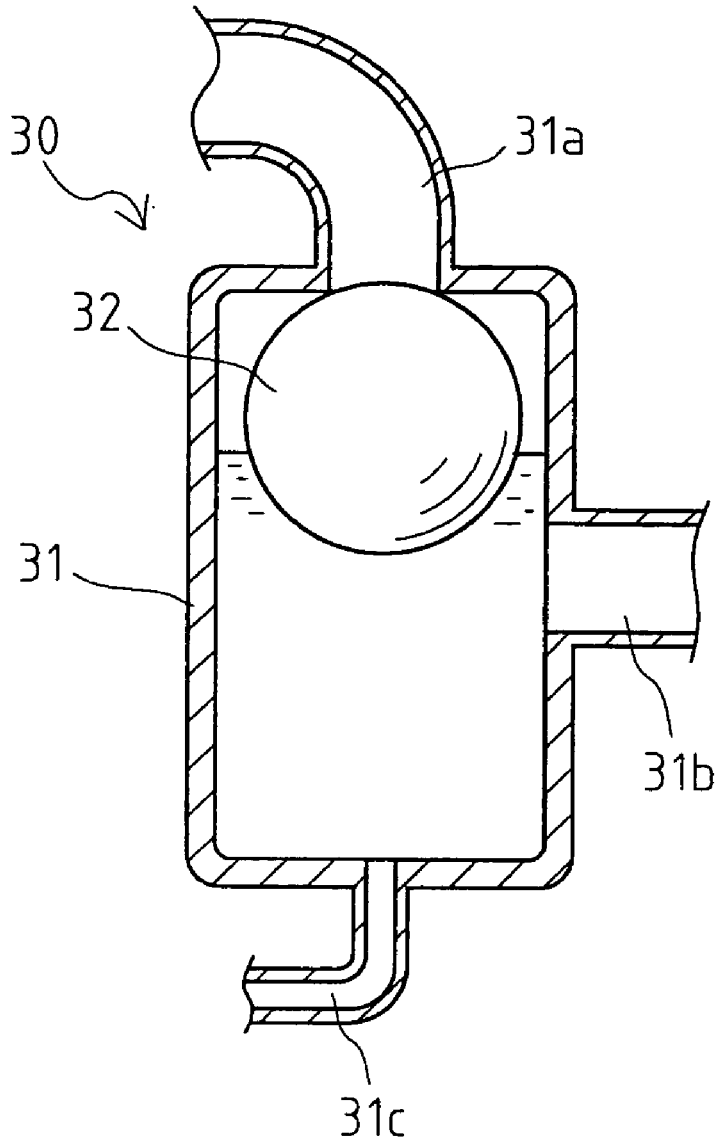
FIG. 13 is a perspective view of an oil hummer inhibiter when oil spouts from the breather chamber.
Figure 14:
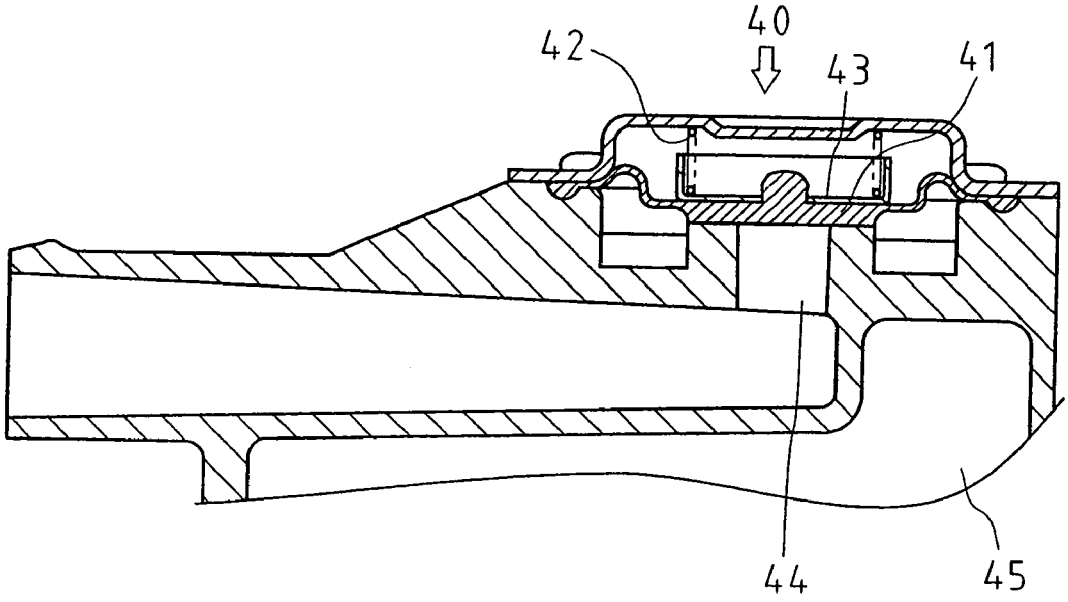
FIG. 14 is an expanded sectional view of a conventional pressure control chamber.

As shown in FIG. 11 to FIG. 13, an oil hummer inhibiter 30 for preventing much oil from being admitted into the intake manifold 16 may be interposed at an intermediate portion of the breather pipe 24. The oil hummer inhibiter 30 has a main body 31 provided therein with a ball-like member 32. The main body 31 is formed in its topside with a gas passage 31*a* connected to the intake manifold 16 through a breather pipe 24*a*. The main body 31 is also formed in its lateral side with a gas passage 31*b* connected to the breather chamber 22 through a breather pipe 24*b*. The main body 31 is further formed in its bottom side with a gas passage 31*c* for letting oil collected in the main body 31 to the intake manifold 16 through a pipe 33.

The ball-like member 32 essentially stays in the lower portion of the main body 31. The blow-by gas introduced into the main body 31 from the gas passage 31*a* connected to the breather pipe 24*a* is passed through the topside of the main body 31 and let into the intake manifold 16 through the gas passage 31*b* connected to the breather pipe 24*b*. When oil spouts from the breather chamber 22 by slanting of the breather chamber 22 or another reason, the spouted oil flows into the main body 31 and the ball-like member 32 floating on the oil in the main body 31 moves upward and closes the upper gas passage 31*b*, thereby preventing sudden movement of oil to the intake side.

In combination with this structure, the pressure-regulating valve 18 for regulating pressure in the breather chamber 22 is arranged at the blow-by gas outlet of the breather chamber 22, and the chock 16*a* is formed at the inlet of the intake manifold 16, into which the blow-by gas passing through the breather chamber 22 is let. Accordingly, the pressure in the valve arm chamber 5 including the breather chamber 22 is stabilized without microseisms causing deterioration and deflection of a seal member. Oil component moved to the intake side is reduced by the orifice 16*a* preventing sudden flow of blow-by gas into the intake manifold 16.

Further, since the oil hummer inhibiter 30 is interposed at the intermediate portion of the breather pipe 24 connecting the breather chamber 22 to the intake manifold 16, sudden flow of much oil into the intake side is prevented, thereby keeping engine performance from falling.

INDUSTRIAL APPLICABILITY

As understood from the above description, the breather device of engine according to the present invention is useful because of its sufficient capacity of removing oil component, i.e., oil mist from blow-by gas.

What is claimed is:

1. A breather device of an engine comprising:

a valve arm casing;

a partition member disposed in the valve arm casing so as to separate an inner space of the valve arm casing into a valve arm chamber and a breather chamber for blow-by gas;

an opening formed between the valve arm casing and the partition member;

a holder disposed in the opening and providing a blow-by gas inlet for introducing blow-by gas from the valve arm chamber into the breather chamber, wherein the holder is formed separately from the partition member; and an oil trap member exchangeably disposed in the holder so as to trap oil mist in blow-by gas, said holder surrounding said oil trap member, and said holder being removable in order to replace said oil trap member.

2. The breather device of an engine as set forth in claim 1, further comprising:

a partition extended from the partition member into the breather chamber; and another partition extended from the valve arm casing into the breather chamber, wherein the partitions are aligned to divide the inside of the breather chamber into a plurality of rooms.

3. The breather device of an engine as set forth in claim 1, further comprising:

a pressure-regulating valve for regulating pressure in the breather chamber, the pressure-regulating valve being disposed near an outlet of the breather chamber.

4. The breather device of an engine as set forth in claim 1, further comprising:

an intake manifold having an inlet for introducing blow-by gas therein from the breather chamber; and an orifice provided to the inlet of the intake manifold.

5. The breather device of an engine as set forth in claim 4, further comprising:

a pressure-regulating valve for regulating pressure in the breather chamber, the pressure-regulating valve being disposed at a blow-by gas outlet of the breather chamber.

6. The breather device of an engine as set forth in claim 1, further comprising:

an intake manifold having an inlet for introducing blow-by gas therein from the breather chamber; and an oil hummer inhibiting device for preventing much oil from being admitted into the intake manifold, the oil hummer inhibiting device being interposed between the breather chamber and the intake manifold.

7. A breather device of an engine comprising:

a valve arm casing;

a partition member disposed in the valve arm casing so as to separate an inner space of the valve arm casing into a valve arm chamber and a breather chamber for blow-by gas;

an opening formed between the valve arm casing and the partition member;

a holder disposed in the opening and providing a blow-by gas inlet for introducing blow-by gas from the valve arm chamber into the breather chamber, wherein the holder is formed separately from the partition member;

an oil trap member exchangeably disposed in the holder so as to trap oil mist in blow-by gas, said holder surrounding said oil trap member, and said holder being removable in order to replace said oil trap member; and another oil trap member provided in the breather chamber so as to trap oil mist in blow-by gas.

8. A breather device of an engine comprising:

a valve arm casing;

a partition member disposed in the valve arm casing so as to separate an inner space of the valve arm casing into a valve arm chamber and a breather chamber for blow-by gas;

an opening formed between the valve arm casing and the partition member;

a holder disposed in the opening and providing a blow-by gas inlet for introducing blow-by gas from the valve arm chamber into the breather chamber, wherein the holder is formed separately from the partition member; and an oil trap member exchangeably disposed in the holder so as to trap oil mist in blow-by gas, said holder surrounding said oil trap member, and said holder being removable in order to replace said oil trap member;

wherein the holder is integrally formed with a guide portion extended outward from the breather chamber into the valve arm chamber so as to introduce blow-by gas from the valve arm chamber to the blow-by gas inlet.

9. A breather device of an engine comprising:

a valve arm casing;

a partition member disposed in the valve arm casing so as to separate an inner space of the valve arm casing into a valve arm chamber and a breather chamber for blow-by gas;

an opening formed between the valve arm casing and the partition member;

a holder disposed in the opening and providing a blow-by gas inlet for introducing blow-by gas from the valve arm chamber into the breather chamber, wherein the holder is formed separately from the partition member;

an oil trap member exchangeably disposed in the holder so as to trap oil mist in blow-by gas, said holder surrounding said oil trap member, and said holder being removable in order to replace said oil trap member; and a vent formed in the holder so as to discharge oil collected in the breather chamber.

10. The breather device of an engine as set forth in claim 9, further comprising:

an intake manifold having an inlet for introducing blow-by gas therein from the breather chamber; and an oil hummer inhibiting device for preventing much oil from being admitted into the intake manifold, the oil hummer inhibiting device being interposed between the breather chamber and the intake manifold.

11. The breather device of an engine as set forth in claim 9, further comprising:

an intake manifold having an inlet for introducing blow-by gas therein from the breather chamber; and an orifice provided to the inlet of the intake manifold.

12. The breather device of an engine as set forth in claim 9, further comprising:

a pressure-regulating valve for regulating pressure in the breather chamber, the pressure-regulating valve being disposed at a blow-by gas outlet of the breather chamber.

* * * * *